US005984142A

United States Patent [19]

Castaldi

[11] Patent Number: 5,984,142

[45] Date of Patent: Nov. 16, 1999

[54] DIFFUSER SET CHILLED DRINKS DISPENSERS FITTED WITH POST-MIX VALVES

[75] Inventor: Bruno Castaldi, Rimini, Italy

[73] Assignee: Celli S.p.A., Coriano (RN), Italy

[21] Appl. No.: 08/949,575

[22] Filed: Oct. 14, 1997

[30] Foreign Application Priority Data

Oct. 15, 1996 [IT] Italy ..... BO96A0516

[51] Int. Cl.[6] ..... B67D 5/56; F17D 31/00

[52] U.S. Cl. ..... 222/129.1; 222/144.5; 222/145.1; 137/625.4

[58] Field of Search ..... 222/129.1, 144.5, 222/145.1; 137/625.4, 625.48, 625.64

[56] References Cited

U.S. PATENT DOCUMENTS

| | | | |
|---|---|---|---|
| 3,503,540 | 3/1970 | Fuerst . | |
| 3,630,230 | 12/1971 | Stable | 137/625.4 |
| 3,893,481 | 7/1975 | Watts | 137/625.4 |
| 4,376,496 | 3/1983 | Sedam et al. | 222/83.5 |
| 4,549,675 | 10/1985 | Austin | 222/129.1 |
| 4,753,372 | 6/1988 | Pocock et al. | 222/94 |
| 4,932,564 | 6/1990 | Austin et al. | 222/129.1 |
| 5,535,923 | 7/1996 | Fujioka | 222/400.7 |

FOREIGN PATENT DOCUMENTS

| | | |
|---|---|---|
| 0344908 | 3/1970 | European Pat. Off. . |
| 0344908 | 3/1988 | European Pat. Off. . |
| 3625325 | 1/1988 | Germany . |
| 2194128 | 3/1988 | United Kingdom . |
| 90/02702 | 3/1990 | WIPO . |
| 9002702 | 3/1990 | WIPO . |

*Primary Examiner*—Andres Kashnikow
*Assistant Examiner*—Keats Quinalty
*Attorney, Agent, or Firm*—Dvorak & Orum

[57] ABSTRACT

A diffuser set for drinks dispensers having delivery groups provided with "post-mix" valves connected to at least two lines for collectively supplying respective drink components, comprising a valve having an output section connected to the "post-mix" valve and at least two input sections provided to receive corresponding drink components to be sent selectively to the output section; and two tubular elements, branched off at least three ways and having respectively first branches connected with corresponding supply lines and second branches taken off the first branch and connected to an input section of the valve in such a way as to send thereto the flow of drink components received from the respective supply lines.

10 Claims, 1 Drawing Sheet

DIFFUSER SET CHILLED DRINKS DISPENSERS FITTED WITH POST-MIX VALVES

BACKGROUND OF THE INVENTION

The present invention relates to a diffuser set for chilled drinks dispensers fitted with "post-mix" valves.

In the technical field pertaining to the delivery and distribution of chilled drinks, the use is known in the prior art of drinks dispensers wherein the drink is prepared immediately before being delivered through the mixing of two or more components which, appropriately chilled, are separately taken to the mixing point. More specifically, the dispensers comprise delivery groups which are individually provided with two distinct ducts that feed the post-mix valve and that, in turn, receive the components of the drink from related distinct supply lines. One of these ducts conveys the syrup, whereas the other one conveys either carbonated water (the so-called soda) or flat water, i.e. water that is free of added gases. The soda, mixing with the syrup, dilutes it allowing to prepare a carbonated drink, whereas the flat water allows to prepare a non carbonated drink such as tea.

Each diffuser set also comprises a communication duct allowing for its collective connection together with other similar diffuser sets to the same supply line in order to allow to obtain dispensers fitted with multiple delivery taps.

In the preparation and in the delivery of the chilled drinks, a general problem is represented by the need to maintain the delivery temperature of the drink constantly controlled.

This is obtained by means of refrigerating systems comprising a tank containing a cooling fluid. In the tank are immersed cooling coils through which the components of the drinks are made to flow; after being chilled, the components are conveyed to the aforesaid dispensers along a section of the supply line positioned between the tank and the dispenser itself.

Along this section of line, however, the components of the drink tend to absorb heat from outside and to become warmer. This disadvantageous effect is particularly intensified by delivery stops because if the distribution system remains idle for some time, the carbonated or flat water located in the aforesaid sections of the respective supply lines tends to warm up more easily.

To obviate this, solutions have been sought that entail the creation of a continuous recirculation of a flow of a component of the drink to be mixed with the syrup, for instance soda, which through a particular pump is continuously made to circulate from the chilling tank to the dispenser and vice versa. One possible way to realize this concept can be obtained with the aid of the same diffuser sets provided for "post-mix" valves. Therein, a flow of carbonated or flat water is made continuously to transit through the duct joining the various diffuser sets of the same dispenser, chilling them even during stops in the delivery of the drinks.

The sets thus obtained require, however, rather costly and cumbersome pumps and thus only one unit is provided for each chilling tank regardless of the number of coils contained, or in other words, regardless of the number of different components of the drink which are conveyed to the dispenser.

Under such conditions, diffuser sets known in the prior art, having available only one duct for the possible continuous recirculation of the chilled soda or of the chilled flat water, in practice do not allow to obtain chilled drink dispensers able to deliver heterogeneous drinks, meaning by that the ability to deliver carbonated drinks through a certain group of delivery taps and flat drinks through other groups of taps.

Moreover, diffuser sets known in the prior art, although used to obtain dispensers able to deliver exclusively drinks of a single type, all carbonated or all flat, do not allow to eliminate the recirculation of at least one of the components of the drink. At least one of the diffuser sets, if not all, must provide for the possibility of recirculating a component of the drink towards the chilling tank, if the risk of delivering drinks at less than optimal temperatures is to be avoided, at least for a certain time interval after a stop in the distribution system.

SUMMARY OF THE INVENTION

A first purpose of the present invention is to eliminate all the aforesaid drawbacks by means of a diffuser set able to be cooled constantly, regardless of the presence of recirculation of some component of the drink and of any stops in the delivery system. An additional purpose is to allow for the realization of configurations of any dispensers able to permit the delivery indifferently of carbonated and non carbonated drinks through their delivery taps. A further purpose is to allow for the realization of modular system configurations, as generic as possible, thus providing for a total freedom of choice between the total exclusion and the only partial exclusion of the recirculation of the drink components, with no need to set specific components for each solution or specialist interventions after the initial installation for modifications to the existing system.

According to the invention, these purposes are reached by means of a diffuser set comprising selector means having an output section connected to the "post-mix" valve to supply it with a component of the drink and having at least two input sections provided to receive separately at least two distinct components of the drink which are connected by two tubular elements, branched at least three ways, and respectively having a first branch connected to a supply line of a component of the drink and a second branch taken off the first and connected to one of the input sections of the selecting means.

The diffuser set can also comprise a duct positioned between the two tubular elements which can be exploited to circulate the cooling fluid contained in the tank of the refrigeration system.

This duct, in addition to providing the advantage of allowing to cool the diffuser set at low cost through the exploitation of the tank which is normally present in the chilling tank, also allows a rather effective heat exchange with the tubular elements conveying the components of the drink and lastly it allows to obtain diffuser sets of reduced size.

BRIEF DESCRIPTION OF THE DRAWINGS

The technical characteristics of the invention, according to the aforesaid purposes, can clearly be seen from the content of the claims reported below and its advantages shall be made more evident in the description that follows, made with reference to the enclosed drawings, which show an embodiment provided purely by way of non limiting example, in which:

DESCRIPTION OF THE PREFERRED EMBODIMENTS

Figure 1:
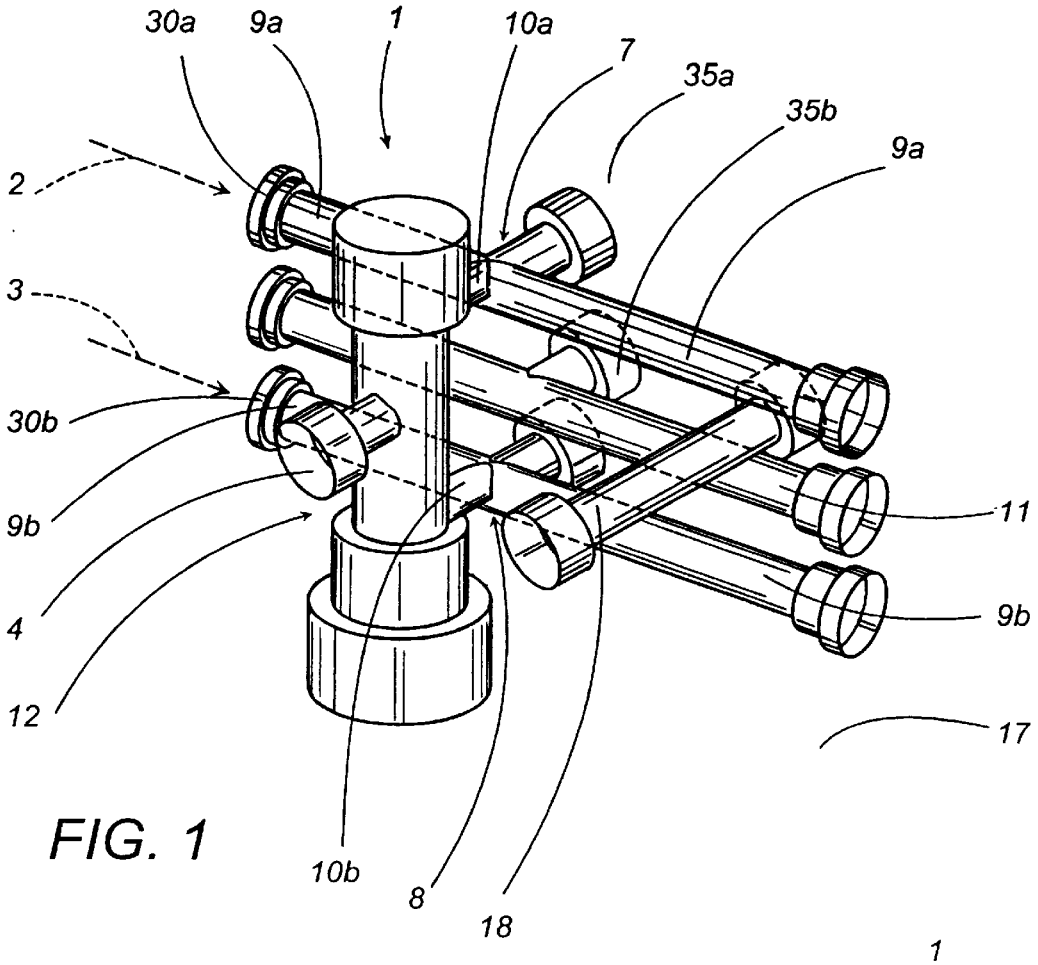
FIG. 1 is a prospective overall view of a diffuser set according to the invention realised with modular construction.

In accordance with the figures of the attached drawings, the number 1 indicates in its entirety a diffuser set for cooled drinks dispensers having delivery groups of the type comprising "post-mix" valves (not shown) which are connected to lines 2, 3 for the collective supply of respective components of the drink, for instance carbonated water (soda) or flat water to be mixed with a syrup to form respectively a carbonated drink or a flat drink, i.e. one with no added gases.

The diffuser set 1 (FIG. 1) essentially comprises a vertical valve 12 and two horizontal tubular elements 7, 8 connected to the valve 12 and contained together therewith in a single modular block 17.

The valve 12 comprises a valve body 25 having an output section 4 connected to a conventional "post-mix" valve (not shown) and two input sections 5, 6 connected respectively to two tubular elements 7, 8.

The valve 12 provides for the valve body 25 to be retained in the modular block 17 itself wherein is also housed a movable spear valve 13 comprising a stem 16 at whose ends are borne two shut-off bodies 15.

The spear valve 13 carries a plug 20 which is integral with one of the shut-off bodies 15, is provided with a seat 26 for inserting an operating tool and is engaged with the valve body 25 in threaded coupling.

Figure 2:
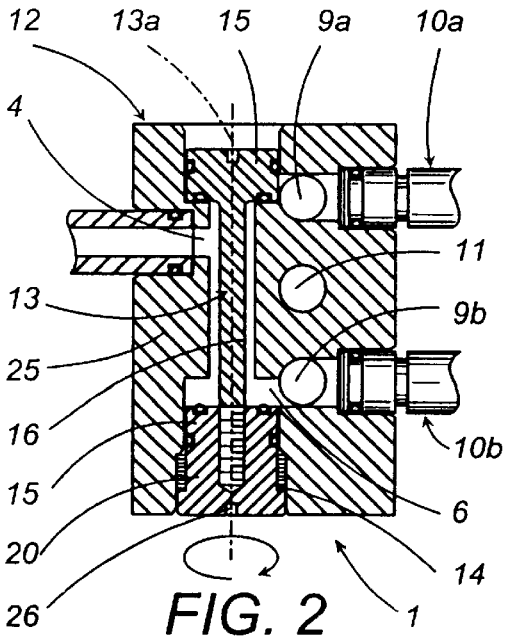
FIGS. 2 and 3 are section views of a detail of the invention as per FIG. 1 shown in two distinct operating states.
Figure 3:
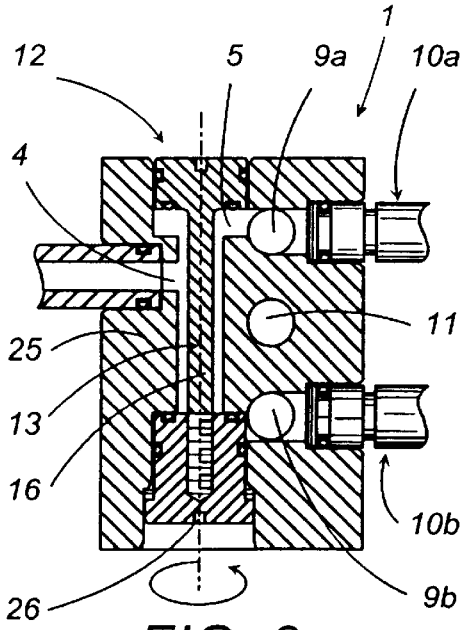

By making the plug 20 rotate, the spear valve 13 is made to move forward or back along its own axial direction 13*a*. This allows to provide a preferable embodiment to more general means for controlling the spear valve 13 which allow to set the shut-off bodies 15 in two extreme conditions (FIGS. 2 and 3) in correspondence with which the input sections 5, 6 of the valve 12 are selectively put in communication with the output section 4.

In regard to the tubular elements 7, 8 in FIG. 1 it is noted in particular that they present, identically to each other, a branched configuration with four coplanar ways, arranged on a horizontal plane.

More specifically, each tubular element 7, 8 comprises a first rectilinear branch 9*a*, 9*b* with an end 30*a*, 30*b* fitted with attachments provided to connect with its own distinct supply line 2, 3 and a second transverse branch 10*a*, 10*b* which is taken off the first branch 9*a*, 9*b* and is connected to the input sections 5, 6 of the valve 12.

The two tubular elements 7, 8 are superimposed one on the other and between them is adjacently set a duct 11 obtained in the block 17 so that it crosses it from one end to the other parallel to the first branches 9*a*, 9*b*.

The modular block 17 also incorporates a duct 18 oriented transversely to the first branches 9*a*, 9*b* of the tubular elements 7, 8 and provided to connect to the "post-mix" valve, in a way that is wholly similar to the output section 4 of the valve 12.

The tubular elements 7, 8 allow to convey to the valve 12 the flows of drink components received from the respective supply lines 2, 3. Connecting then onto one of the tubular elements 7, 8 a line for the supply of carbonated water and on the other a line for the supply of flat water it is possible to deliver a carbonated or a flat drink, on a same delivery group simply by moving the spear valve 13 in the valve 12 to the suitable condition to send to the "post-mix" valve one or the other of the drink components to be mixed with the syrup coming from the duct 18. Thus it appears clear that the valve 12 represents a preferable embodiment of the selector means able to send to the "post-mix" valve the soda or the flat water for the formation of a carbonated or uncarbonated drink, as the case may be. The four-way conformation of the tubular elements 7, 8 allows to have a supplementary attachment 35*a*, 35*b* useful in case of particular size problems. Moreover this conformation also allows to realise any type of system with or without recirculating the drink components towards the chilling tank of the coils, since the selection of one or the other drink components performed by the valve 12 does not shut off the flows taking place upstream thereof.

It is thus clear that by providing for the recirculation of the carbonated water or of the flat water the modular block 17 has the ability of being cooled continuously even during delivery interruptions.

The intermediate duct to the tubular elements 7, 8 allows additional installation options. It can be conveniently flowed through by the fluid contained in the chilling tank circulated by the stirring pump normally provided in all systems of this kind. In so doing, the modular block 17 is continuously cooled regardless of the installation options provided for the soda and the flat water. It is clear that if the possibility of recirculating the latter components towards the refrigerating system is excluded through the installation of suitable stoppers to shut off the unused outputs, by itself the recirculation of the tank fluid allows to accomplish the cooling of the modular block 17 thus allowing much simplified and highly economical constructive solutions.

An additional advantageous aspect, correlated to the constructive form of the diffuser set according to the invention can also be found in the possibility of obtaining easily and rapidly dispensers of mixed drinks wherein the modular blocks 17 can be hooked up together in configurations of minimum size with the respective branches 9*a*, 9*b* of the tubular elements 7, 8 and the respective ducts 11 for conveying the cooling fluid of the tank arranged in mutual continuation.

The invention thus conceived can be subject to numerous modifications and variations, without thereby departing from the scope of the inventive concept. Moreover, all components may be replaced with technically equivalent elements.

What is claimed:

1. A diffuser set for use with chilled drink dispensers having a plurality of delivery groups, each group having at least to two lines for the collective supply of respective components of a drink, each supply line fitted with a post-mix valve thereon, comprising:

selector means having an output section for connection to a post-mix valve, at least two input sections for receiving and sending components comprising a drink, said input sections in fluid communication with the output section, and a spear valve movable between a first and second condition wherein each of said conditions, said output section is in fluid communication with a respective said input section, said spear valve includes a pair of spaced shut-off bodies positioned at opposite ends of a stem, wherein said stem is movable bi-directionally upon activation of a related control means, said control means comprising a plug integral with one of the shut-off bodies and operable with the body of the valve, at least two identical tubular elements each having a respective first branch connected with a respective supply line and a respective second branch connected to a respective input section of the selector means in such a way so as to send thereto a flow of the drink components received from the respective supply lines.

2. The diffuser set according to claim 1, wherein the tubular elements are connected respectively to a line for the supply of carbonated water and to a line for the supply of flat water.

3. The diffuser set according to claim 1, further including a duct for conveying a flow of a cooling, fluid therethrough, said duct disposed adjacently with at least one of said first branches of the tubular elements.

4. The diffuser set according to claim 3, wherein the conveying duct is disposed between said first branches.

5. The diffuser set according to claim 3, wherein the conveying duct conveys a flow of a cooling fluid from a tank of a refrigerating system.

6. The diffuser set according to claim 1, wherein said set is contained within a single modular.

7. The diffuser set according to claim 6, wherein a duct is disposed across the entire modular block.

8. The diffuser set according to claim 7, wherein the duct is disposed transversely to and between said respective first branches of the tubular elements.

9. The diffuser set according to claim 1, wherein the tubular elements are provided with four branches.

10. The diffuser set according to claim 1, wherein the branches of said tubular elements are coplanar.

* * * * *